US009157598B2

(12) United States Patent
Tralli et al.

(10) Patent No.: US 9,157,598 B2
(45) Date of Patent: Oct. 13, 2015

(54) HEAT MANAGING DEVICE

(75) Inventors: Aldo Tralli, Arnhem (NL); Theodoor Cornelis Treurniet, Best (NL); Ralph Kurt, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 753 days.

(21) Appl. No.: 13/380,535

(22) PCT Filed: Jun. 21, 2010

(86) PCT No.: PCT/IB2010/052789
§ 371 (c)(1), (2), (4) Date: Dec. 23, 2011

(87) PCT Pub. No.: WO2010/150170
PCT Pub. Date: Dec. 29, 2010

(65) Prior Publication Data

US 2012/0092870 A1 Apr. 19, 2012

(30) Foreign Application Priority Data

Jun. 25, 2009 (EP) ..... 09163711

(51) Int. Cl.
*F21V 29/00* (2015.01)
*F21S 8/10* (2006.01)
(Continued)

(52) U.S. Cl.
CPC ..... *F21S 48/325* (2013.01); *F21K 9/00* (2013.01); *F21V 29/006* (2013.01); *F21V 29/505* (2015.01); *F21V 29/677* (2015.01); *F21V 29/713* (2015.01); *F21V 29/74* (2015.01); *F21V 29/773* (2015.01); *F21Y 2101/02* (2013.01)

(58) Field of Classification Search
CPC ..... F21V 29/74; F21V 29/006; F21V 29/713; F21V 29/717; F21V 29/773; F21V 29/677; F21V 29/505; F21S 48/325; F21K 9/00; F21Y 2101/02
USPC ..... 362/294, 373
See application file for complete search history.

(56) References Cited

U.S. PATENT DOCUMENTS 5,842,843 A * 12/1998 Haga ..... 418/55.2
6,200,602 B1 3/2001 Watts et al.
(Continued)

FOREIGN PATENT DOCUMENTS

CN 2934916 Y 8/2007
CN 101349418 A 1/2009
(Continued)

*Primary Examiner* — Mary McManmon
(74) *Attorney, Agent, or Firm* — Yuliya Mathis

(57) ABSTRACT

It is presented a heat managing device for a light source (100) which combines heat managing by means of a heat sink, heat pipes and forced convection, thereby achieving efficient cooling of high power lighting applications. The heat managing device comprises a heat spreading element (104) having an upper side arranged for thermally connecting to at least one light source (106). The light emitted from the light source is controlled by secondary optics (103). The heat managing device comprises a heat sink which is thermally connected to the heat spreader, and to a first set of heat pipes which is thermally connected to the heat spreader. At least a portion of the heat sink is arranged to encompass the secondary optics. The heat pipes are embedded in the heat sink. Further, a fan for providing forced air convection at the heat sink is comprised in the device. A corresponding lighting device is also presented.

18 Claims, 5 Drawing Sheets

(51) Int. Cl.

| | |
|---|---|
| ***F21K 99/00*** | (2010.01) |
| ***F21V 29/505*** | (2015.01) |
| ***F21V 29/67*** | (2015.01) |
| ***F21V 29/71*** | (2015.01) |
| ***F21V 29/74*** | (2015.01) |
| ***F21V 29/77*** | (2015.01) |
| *F21Y 101/02* | (2006.01) |

(56) References Cited

U.S. PATENT DOCUMENTS

| | | | | |
|---|---|---|---|---|
| 7,144,135 | B2 | 12/2006 | Martin et al. | |
| 7,210,832 | B2 * | 5/2007 | Huang | 362/547 |
| 7,314,291 | B2 | 1/2008 | Tain et al. | |
| 7,434,964 | B1 | 10/2008 | Zheng et al. | |
| 7,461,952 | B2 * | 12/2008 | Trenchardl et al. | 362/294 |
| 7,654,702 | B1 * | 2/2010 | Ding et al. | 362/294 |
| 8,322,892 | B2 * | 12/2012 | Scordino et al. | 362/294 |
| 2005/0111234 | A1 | 5/2005 | Martin et al. | |
| 2005/0275937 | A1 | 12/2005 | Wu et al. | |
| 2006/0007013 | A1 * | 1/2006 | Singer et al. | 340/815.45 |
| 2006/0215408 | A1 | 9/2006 | Lee | |
| 2007/0086196 | A1 | 4/2007 | Wong | |
| 2008/0117637 | A1 * | 5/2008 | Chang et al. | 362/294 |
| 2008/0149305 | A1 | 6/2008 | Chen | |
| 2008/0212325 | A1 | 9/2008 | Wang | |
| 2009/0040760 | A1 * | 2/2009 | Chen et al. | 362/249 |
| 2009/0059594 | A1 | 3/2009 | Lin | |
| 2010/0128482 | A1 * | 5/2010 | Zhou et al. | 362/253 |
| 2010/0172133 | A1 * | 7/2010 | Liu | 362/235 |
| 2010/0259942 | A1 * | 10/2010 | Lee | 362/373 |

FOREIGN PATENT DOCUMENTS

| | | | |
|---|---|---|---|
| CN | 101387392 | A | 3/2009 |
| EP | 1881259 | A1 | 1/2008 |
| JP | 20063126337 | B2 | 1/2001 |
| JP | 2005158746 | A | 6/2005 |
| JP | 2006202612 | A | 8/2006 |
| JP | 2006286395 | A | 10/2006 |
| JP | 2007528588 | A | 10/2007 |
| JP | 2008502951 | A | 1/2008 |
| JP | 2008047383 | A | 2/2008 |
| JP | 2008218386 | A | 9/2008 |
| JP | 2008305713 | A | 12/2008 |
| JP | 2009004276 | A | 1/2009 |
| JP | 2009048994 | A | 3/2009 |
| WO | 2008011723 | A2 | 1/2008 |
| WO | 2009071111 | A1 | 6/2009 |

* cited by examiner

HEAT MANAGING DEVICE

FIELD OF THE INVENTION

The present inventive concept generally relates to light emitting diode devices, and more particularly to heat managing of high power light emitting diode devices.

BACKGROUND OF THE INVENTION

Notwithstanding the dramatic improvement in energy efficiency over more traditional light sources, light sources utilizing light emitting diodes (LEDs) still convert between 50 to 80% of the power they are fed into heat. At the same time, LED performance with respect to efficiency and color stability is quite sensitive to temperature increase, and especially for high temperatures above 80° C. This criticality is particularly evident in high power LED applications. Traditionally, heat sinks and forced air convection have been utilized for heat management of LED devices. More recently heat pipes have been employed for heat managing of LED devices. A heat pipe is an evaporator-condenser system in which a liquid is returned to the evaporator by capillary action. In its simplest form a heat pipe consists of a vacuum tight hollow tube with a wick structure along the inner wall, and a working fluid. The wick structure may be porous, such as sintered powder metal, wrapped, consist of axially arranged grooves, screens etc. The center core of the tube is left open to permit vapor flow. The heat pipe is evacuated and then back-filled with a small quantity of working fluid, just enough to saturate the wick. Examples of applicable working fluids are sodium, lithium, water, ammonia, and methanol. The atmosphere inside the heat pipe is set by an equilibrium of liquid and vapor. The heat pipe has three sections: evaporator, adiabatic and condenser. Heat applied at the evaporator section (also referred to as the hot part herein under) is absorbed by the vaporization of the working fluid. The vapor is at a slightly higher pressure, which causes it to travel down the center of the heat pipe, through the adiabatic section to the condenser section. At the condenser section (also referred to as the cold part herein under) the lower temperatures cause the vapor to condense giving up its latent heat of vaporization. The condensed fluid is then pumped back to the evaporator section by the capillary forces developed in the wick structure. Heat pipe operation is completely passive and continuous. This continuous cycle transfers large quantities of heat with very low thermal gradients. The operation of a heat pipe is passive, and is driven only by the heat that is transferred. In a gravity field, the evaporator may be placed below the condenser to assist the liquid flow. Heat pipes may be arranged in different shapes.

It is known to combine a heat sink, heat pipes and forced convection for heat management of LED based lighting devices. U.S. Pat. No. 7,144,135 B2, discloses a lighting device comprising a LED light source which is arranged on a heat sink. The heat sink is arranged with fins and/or heat pipes. An optical reflector encompasses the light source. The device further comprises an exterior shell in which the optical reflector is disposed such that an air channel is formed between the optical reflector and the shell. The fins and/or heat pipes of the heat sink are arranged to extend along the air channel. Further, a fan is arranged under the heat sink and causes air to flow from air inlets and air exhaust apertures defined by the shell/optical reflector such that the heat sink is cooled. In an exemplifying embodiment, a Luxeon 500 lm LED is cooled.

SUMMARY OF THE INVENTION

It is an object of the present invention to achieve an alternative and improved heat managing device for high power light sources.

According to a first aspect of the present inventive concept there has been provided a heat managing device for a light source. The heat managing device comprises a heat spreading element having an upper side arranged for thermally connecting to at least one light source, and secondary optics for controlling light emitted from the light source. The device further comprises a heat sink being thermally connected to the heat spreader, a first set of heat pipes being thermally connected to the heat spreader, and a fan for providing forced air convection at the heat sink. At least a portion of the heat sink is arranged to encompass the secondary optics. The heat pipes are embedded in the heat sink.

Thereby a heat managing device is provided which allows efficient heat management for a light source having secondary optics by means of a combination of forced convection and heat pipes that are embedded inside the heat sink. Since the heat sink is thermally connected to the heat spreader on which the light source is arranged, some of the generated heat is transported directly to the heat sink via the heat spreader. Further, the heat sink encompasses the secondary optics such that heat formed at the secondary optics may also be managed by the heat sink. This arrangement further allows for utilizing a large angular space of the device for heat managing purposes. Referring now to angles of cross sections through a heat managing device for a light source, which comprises e.g. LEDs, a conventional heat management system for the LED light source cover about 180° (typically arranged below the LED light source). The space (180°) above the LED is used for optical purpose which may allow for design and application freedom. In the present inventive concept, typically less than 90° of the space is used for the secondary optics. The secondary optics is encompassed by at least part of the heat sink, and consequently more than 250°, and preferably more than 270°, and most preferred more than 300° of the space, may be used for the heat management system, thus providing a high efficiency for the heat management, which is advantageous for high power applications. The angels above refer to a cross section through the system.

To continue, the wetted surface of the heat sink needs to be considerably large in order to effectively dissipate a large amount of heat by means of natural or forced convection. This in turn would cause considerably large temperature gradients in the heat sink, even if a good conductive material, such as e.g. aluminium is used. In the present inventive concept these temperature gradients are advantageously decreased by the heat pipes which are embedded in the heat sink. Further, the fan may be arranged to provide forced air convection at the heat spreader, the heat sink or both. The heat sink/heat pipes in combination with the forced convection provided by the fan, will efficiently cool down the heat managing device such that it is capable of dissipating heat generated by a high power light source. The heat managing device provides a solution to efficiently manage a light source with a thermal power (to be cooled) between 100 W and 1000 W, and preferably between 200 W and 700 W, and most preferably between 300 W and 500 W.

The secondary optics may comprise mixing optics, collimation optics, reflectors, lenses, zoom and/or focusing optics, see U.S. Pat. No. 6,200,002 by Marshall et al. which is hereby incorporated by reference.

According to an embodiment of the heat managing device, the secondary optics is arranged at the heat spreading element and is further arranged to encompass the light source, which is advantageous for providing e.g. collimating structures.

According to an embodiment of the heat managing device, the heat sink further comprises a cavity in flow communication with space via at least one aperture, within which cavity the fan is arranged. Thus, the fan is integrated within the heat sink such that the heat sink forms the outer casing for the heat managing device.

According to an embodiment of the heat managing device, the first set of heat pipes is arranged to extend along the secondary optics. The heat pipes are used to effectively bridge the temperature gradients in the heat sink, thus the temperature gradients are reduced and therefore a more efficient cooling is achieved.

According to an embodiment of the heat managing device, the first set of heat pipes is arranged at a bottom side of the heat spreading element. Optionally, the first set of heat pipes may also be (at least partially) embedded in the heat spreading element. When having a heat sink which additionally extends in a direction from the bottom side of the heat spreading element, heat pipes are arranged to effectively bridge temperature gradients in this part of the heat sink, which is advantageous for achieving efficient cooling.

According to an embodiment of the heat managing device, the device further comprises a second set of heat pipes being thermally connected to the heat spreader and arranged on an opposite side of the heat spreader with respect to the first set of heat pipes, which provides an increased cooling effect and a more balanced temperature distribution in a large heat sink, which may extend in two opposite directions from the light heat spreader element. The heat sink may advantageously be arranged extending substantially symmetrically with respect to the heat spreader element.

According to an embodiment of the heat managing device, the heat pipes are at least partly embedded in the heat spreader. The evaporator sections of the heat pipes are advantageously arranged embedded in the heat spreader for high heat managing efficiency. The condenser section of each heat pipe is embedded in the heat sink. This advantageously decreases the temperature gradients which will arise between the heat spreader, which has the highest temperature typically occurring at the light source, and the (remote parts of) heat sink.

According to an embodiment of the heat managing device, the secondary optics is one of parabolic, elliptic, cone, and trumpet shaped.

The secondary optics may be a collimating unit which is a typical optical component for a lighting device.

According to an embodiment of the heat managing device, the heat sink comprises a parabolic or conical cavity in which the second optics is arranged. This allows for arranging the secondary optics either by mounting of a secondary optics in the cavity, or for actually providing the secondary optics as an integrated part of the heat sink, e.g. by means of a dielectric or metallic coating on the surface of the cavity. This provides a mechanically stable device. Further, in the latter case the number of constituent parts of the device is decreased.

According to an embodiment of the heat managing device, the heat sink is arranged having fins. In order to effectively dissipate a large amount of heat by means of natural or forced convection, the wetted surface of the heat sink needs to be considerably large. By providing the heat sink with fins, the wetting surface is advantageously increased which in turn increases the cooling efficiency of the heat managing device.

According to an embodiment of the heat managing device, the fins are arranged such that the outer shape of the heat sink forms a truncated spheroid, a cylinder, or a truncated cone. These shapes of the heat sink is advantageous since a high ratio between the wetting surface with respect to the total volume of the heat managing device is achieved.

According to an embodiment of the heat managing device, the at least one light source is a solid state light emitting element, and in particular a light emitting diode or a laser. Thus the present inventive concept advantageously provides an efficient heat managing device for high power LED applications.

According to an embodiment of the heat managing device, at least one of the heat pipes is a planar heat pipe. Planar heat pipes are advantageously utilized to serve both for heat spreading as well as for providing wet surfaces. Furthermore, planar heat pipes may be arranged to be less sensitive to orientation (i.e. decreasing the influence of gravity on the heat pipes). Moreover, utilizing planar heat pipes is effective when the optics of the device is pointed downwards, for instance in applications like theatre spots.

According to a second aspect of the present inventive concept there has been provided a lighting device employing a heat managing device in accordance with the present inventive concept. The lighting device comprises at least one light source mounted in a heat managing device.

Thus, as previously described the heat managing device is highly effective for managing heat generated by the at least one light source. Thereby there is provided a lighting device which allows for utilizing a large number of light sources or a single high power light source for providing a high brightness. The lighting device is advantageously cooled by means of the combination of forced convection and heat pipes that are embedded in the heat sink. Furthermore, the lighting device advantageously forms a compact functional high brightness light source unit.

According to an embodiment of the lighting device, the device is adapted to retrofit into a luminaire employing an incandescent light source, thereby providing a lighting device fitting into a luminaire which normally employs e.g. an incandescent high power light source. In the context of the present invention, the term "retrofitting" means fitting into a light fixture normally used for incandescent light sources, such as a filamented light bulb, a halogen lamp, etc. In other words, by retrofitting the light source according to the present invention into a luminaire normally employing an incandescent light source it is meant replacing the incandescent light source in the luminaire with the light source according to the present invention.

Furthermore, the second aspect of the invention generally has the same features and advantages as the first aspect.

Some of the embodiments of the present inventive concept provide for a novel and alternative way of managing heat generated by light sources. It is an advantage with some embodiments of the invention that they provide for improved heat management as well as a mechanically stable and compact device with integrated active cooling. It is noted that the invention relates to all possible combinations of features recited in the claims.

Other objectives, features and advantages of the present inventive concept will appear from the following detailed disclosure, from the attached dependent claims as well as from the drawings.

Generally, all terms used in the claims are to be interpreted according to their ordinary meaning in the technical field, unless explicitly defined otherwise herein. All references to "a/an/the [element, device, component, means, etc]" are to be interpreted openly as referring to at least one instance of the element, device, component, means, etc., unless explicitly stated otherwise.

BRIEF DESCRIPTION OF THE DRAWINGS

This and other aspects of the present invention will now be described in more detail, with reference to the appended drawings showing embodiment(s) of the invention, in which.

DETAILED DESCRIPTION

Embodiments according to the present inventive concept will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout.

Figure 1:
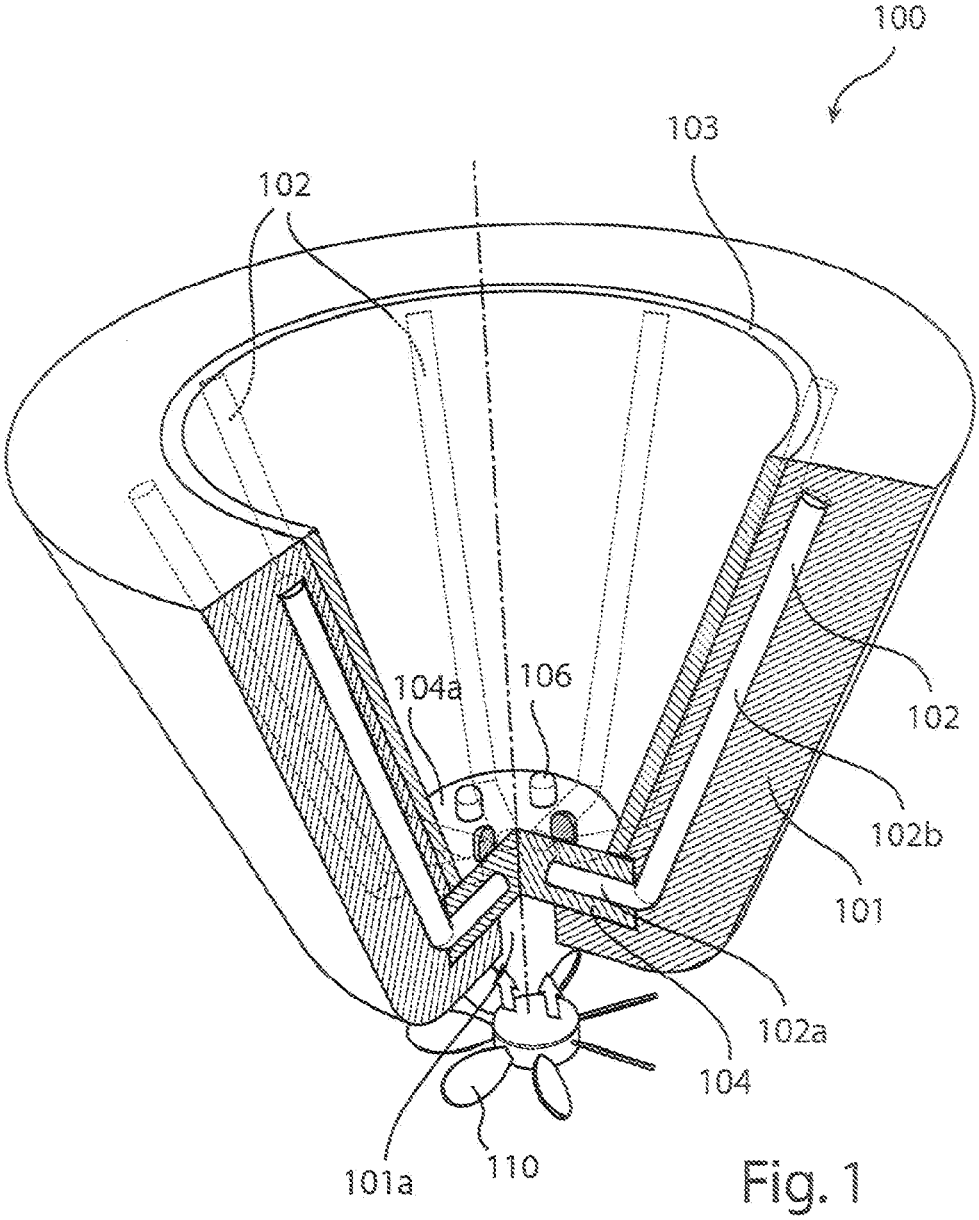
FIG. 1 is a schematic sectional perspective view of an embodiment of a heat managing device in accordance with the present inventive concept.

An exemplifying embodiment of the heat managing device 100 is illustrated in FIG. 1. The heat managing device 100 comprises a cylinder shaped heat spreader 104 arranged in thermal contact with, and at the narrow end of a heat sink 101, which is shaped like a truncated cone. Part of the upper surface 104*a* of the heat spreader 104 is encompassed by the parabolic wall formed by the heat sink 101.

Further, secondary optics 103 is arranged within the parabolic wall formed by the heat sink 101. The secondary optics 103 is here a collimating structure in the shape of a truncated cone, which is arranged having its narrow opening arranged at the heat spreader 104 with the purpose of collimating the light emitted from LEDs 106. The LEDs 106 are arranged on the upper surface 104*a* of the heat spreader 104. An aperture 101*a* in the heat sink 101 provides access for air cooling, and optionally electronic wiring (not shown) for control and powering of the light sources 106. In this exemplifying embodiment, the aperture 101*a* is arranged such that a subsurface of the heat spreader 104, which is opposite to the upper surface 104*a*, is accessible.

Further, the secondary optics 103 is arranged to fit into the heat sink 101. The secondary optics can be made out of thin flexible sheets e.g. aluminium or Miro foils (see www.Alanod.de). These foils can be shaped according to the requirements of a particular application, e.g. a shape predetermined by the shape of the heat sink. In alternative embodiments, the secondary optics may optionally be provided by surface treatment of the inner surface of the heat sink, e.g. by means of evaporation of a reflective coating, or multiple thin layers of materials to form a total internal reflection (TIR) filter. The secondary optics may be separated from the heat spreader by a thin insulating layer or spacing (not shown).

Furthermore, a plurality of heat pipes 102 are partly embedded in the heat spreader 104. The heat pipes 102 are arranged to extend from the heat spreader 104 into the heat sink 101, and further along the extension of the wall of the heat sink 101. In FIG. 1 seven heat pipes 102 are visible. The heat pipes are symmetrically arranged in the heat managing device 100, and are in a first end portion 102*a* extending in a radial direction from the center of the heat spreader 104. Further, in a second end portion 102*b*, the heat pipes 102 are arranged to extend along the wall of the heat sink 101, and thus along the secondary optics 103.

The LEDs 106 are mounted onto the upper surface 104*a* of the heat spreader 104 by means of soldering, thus providing efficient thermal contact between the heat spreader 104 and the LEDs 106. The mounting of the LEDs may optionally be done by means of heat conducting glue or mechanical attachment to the heat spreader. As mentioned above, the LEDs are further arranged having wiring for powering and/or control of the LEDs. The wiring is preferably arranged to run through the heat spreader and further via the aperture 101*a* to a powering and/or control unit (not shown). For sake of simplicity the wiring and the external powering and/or control unit are not shown herein.

The material of the heat sink 101 may be, e.g. aluminium, aluminium alloy, brass, copper, steel, stainless steel, or any suitable thermally conductive material, compound, or composite. The heat spreader 104 is or comprises Cu, Au, Al, Fe, steel, or ceramics such as AlN, $Al_2O_3$, or MCPCB (metal core printed circuit board), or IMS (insulated metal substrate, wherein the metal is CU, Al, or steel). Thus, the material is preferably a suitable material with a high thermal conductivity, which is capable of providing efficient heat transfer from the heat sources, i.e. mainly the LEDs.

Further, a fan 110 is arranged at the narrow end of the heat sink 101. Forced air convection is provided at the heat sink, and the heat spreader via the aperture 101*a*. Preferably the fan is positioned at the lower end of the heat managing device, and preferably at the symmetry axis of the system. Optionally the fan is arranged at any suitable location for providing forced air convection at the heat sink 101. The purpose of the fan 110 is to increase the heat transfer from the wet surfaces to air.

Figure 2A:
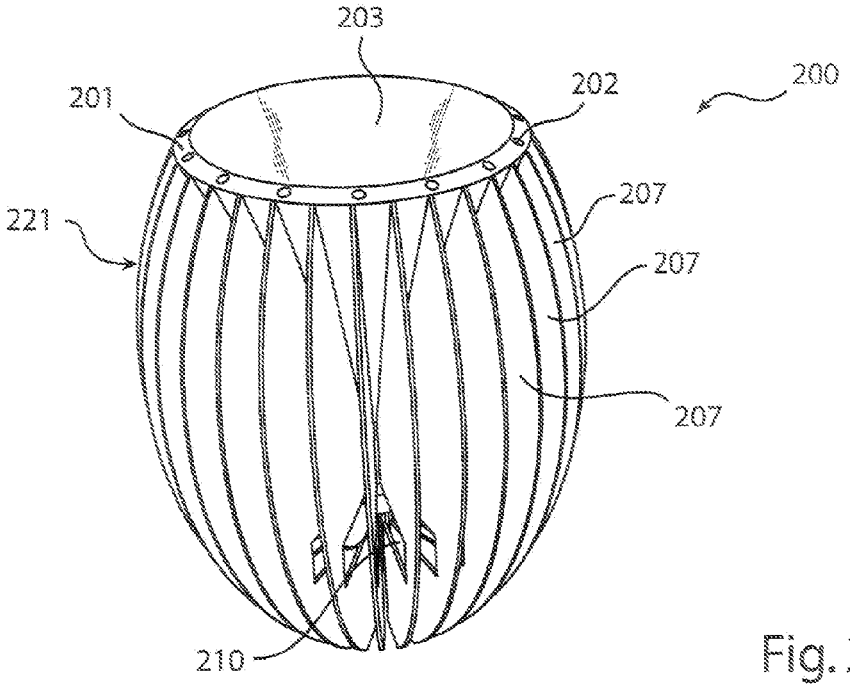
FIG. 2*a* is a schematic perspective front view.
Figure 2B:
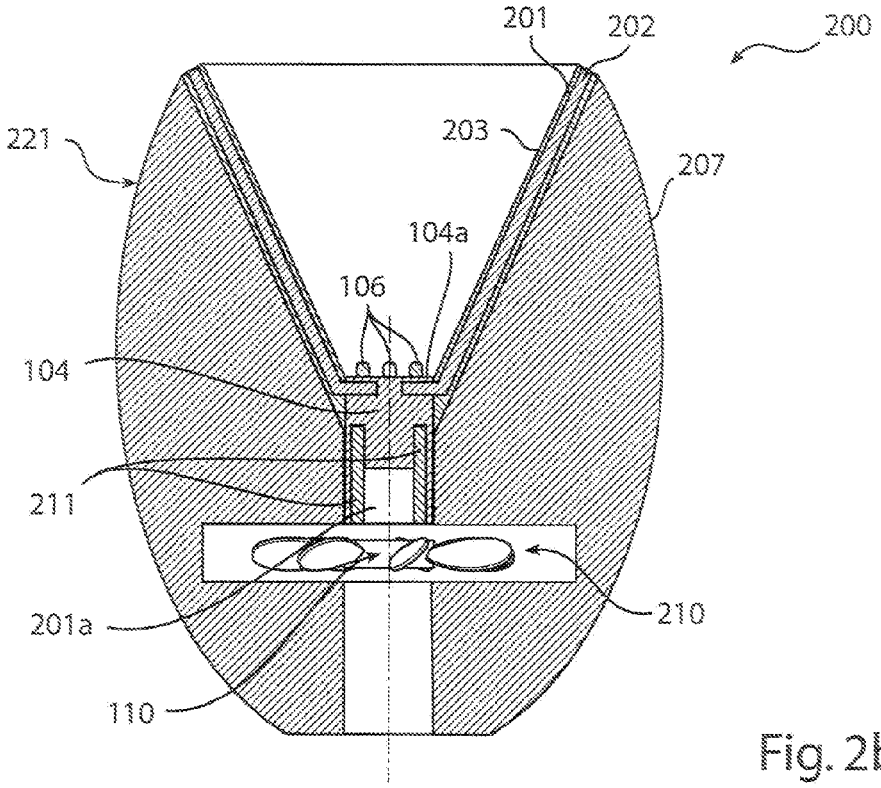
FIG. 2*b* is a cross-sectional view illustrating an embodiment of a heat managing device in accordance with the present inventive concept.

Referring now to FIGS. 2*a* and 2*b*, in which an embodiment 200 in accordance with the present inventive concept is presented. The heat managing device 200 comprises a cylinder shaped heat spreader 104 arranged in thermal contact with, and at the narrow end of a conical part 201 of a heat sink 221. The conical part 201 is shaped like a truncated cone. Part of the upper surface 104*a* of the heat spreader 104 is encompassed by the parabolic wall formed by the conical part 201.

Further, secondary optics 203 are arranged within the parabolic wall formed by the heat sink 201. The secondary optics 203 controls the direction of light emitted from LEDs 106, which are arranged on the upper surface 104*a* of the heat spreader 104. The secondary optics 203 is here provided as an aluminium foil mounted to cover the inner surface of the conical part 201.

Furthermore, a plurality of heat pipes 202 are partly embedded in the heat spreader 104, and arranged to extend from the heat spreader 104 into the conical part 201, and further along the extension of the wall of the conical part 201. In FIG. 2*b* two heat pipes 202 are visible. The heat pipes are symmetrically arranged in the heat managing device 200, and are basically arranged as in the previously described embodiment 100. However, here the heat pipes 202 extend along the wall up to the outer rim of the conical part 201. Optionally, the heat pipes may extend outside the outer rim of the conical part 201.

In alternative embodiments, the length of the heat pipes 202 are between 0.5 and 2 times the length of the secondary optics, and preferably between 0.7 and 1.3 times the length of the secondary optics. In a preferred embodiment 5-30 heat pipes are used in the first set of heat pipes, preferably between 7 and 21, most preferably 7, 9, 14 or 18. The number of heat pipes is preferably adapted to fit to the symmetry of the used secondary optics.

Furthermore, a second set of heat pipes 211 is arranged partly embedded in the heat spreader 104 and extending in a direction from the bottom side of the heat spreader 104 into a cavity 201*a* which is arranged under the heat spreader 104.

The heat sink 221 is further arranged having a plurality of fins 207. The fins 207 are pheripherically (and optionally symmetrically) arranged partly on the outer surface of the heat sink 201, and further extending below the conical part 201. (The fins may optionally be arranged solely on the conical part). The total outer surface area of the fins is according to a preferred embodiment between 0.05 $m^2$ and 0.8 $m^2$, preferably between 0.1 $m^2$ and 0.6 $m^2$, most preferably between 0.2 $m^2$ and 0.4 $m^2$. The number of the fins is according to a preferred embodiment between 7 and 32, preferably between 10 and 20, and most preferably between 12 and 16. Alternatively, the number of fins is set in relation to the number of heat pipes: 1 times, 2 times, 3 times or 4 times the number of heat pipes. The total extension of the conical part 201 and the fins 207 are typically arranged to extend either to fit the secondary optics, or as in this exemplary embodiment to be approximately two times longer than the secondary optics. The material of the fins 207 is or comprises a metal (such as e.g. Al, Cu, Fe), a ceramic (such as e.g. $Al_2O_3$, MN, $TiO_x$) and/or a material comprising carbon (such as e.g. graphite, diamond, or organic molecules including composites).

A cavity 210 is formed inside the heat sink 221 in which the fan 110 is arranged for providing forced air convection.

A light source applicable for the present inventive concept, is typically a LED array, having a small size. According to embodiments of the current invention light source diameters between 10 mm and 100 mm, preferably between 20 mm and 50 mm, and most preferably about 30 mm are suitable. The power density in the exemplifying light source is typically between $1\times10^6$ and $5\times10^7$ W/$m^2$.

The resulting temperature differences between the heat spreader and the ambient air (25° C.) is <100° C., preferably <90° C., most preferably <80° C.

In an embodiment, the light source comprises a plurality of LEDs, preferably a LED array comprising preferably 9-500 LEDs, and more preferably 50-200 LEDs. In a preferred embodiment the LEDs are packed closely together with a pitch (distance between individual light emitting elements) between 200 μm and 5 mm, preferably between 500 μm and 3 mm and most preferably between 2 mm and 3 mm.

In another preferred embodiment the light source comprises a plurality of individually addressable colored LEDs (emitting light with colors such as R, G, B, A, C, W, WW, NW).

Figure 2C:
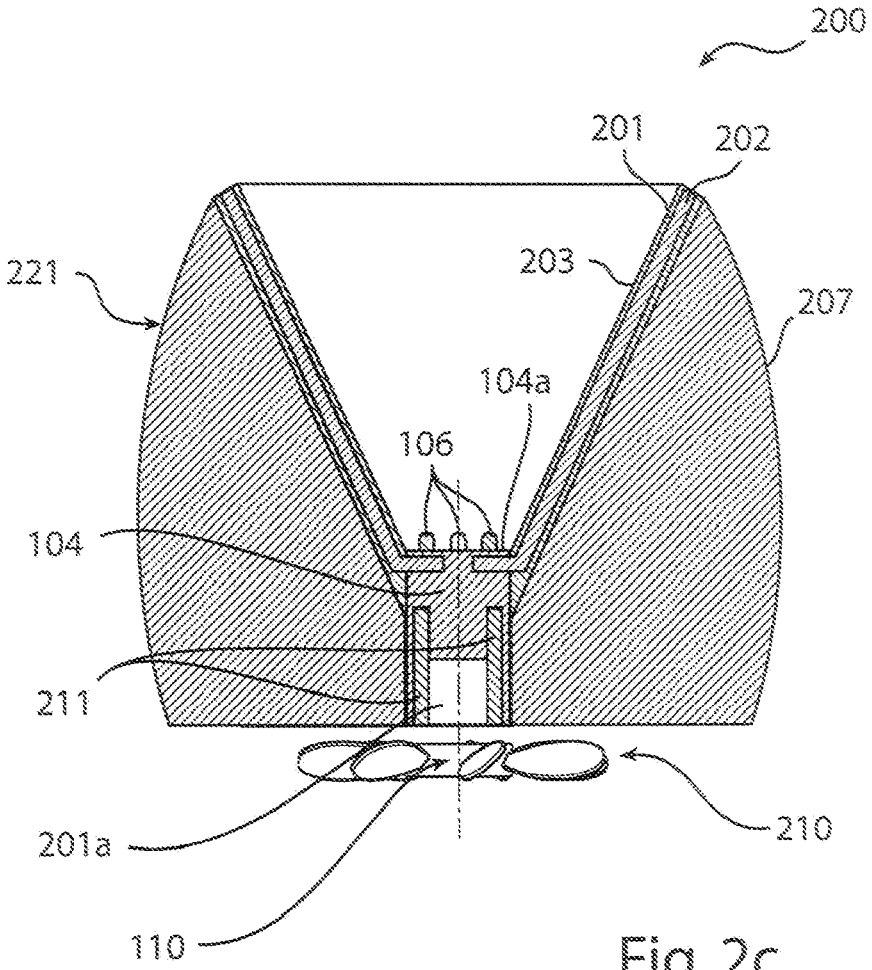
FIG. 2*c* is a cross-sectional view of an alternative embodiment of the heat managing device shown in FIGS. 2*a* and 2*b*.

FIG. 2*c* illustrates an embodiment similar to the embodiment described above with reference to FIGS. 2*a* and 2*b*, in which the fan 110 is arranged below the heat sink 221.

Figure 3:
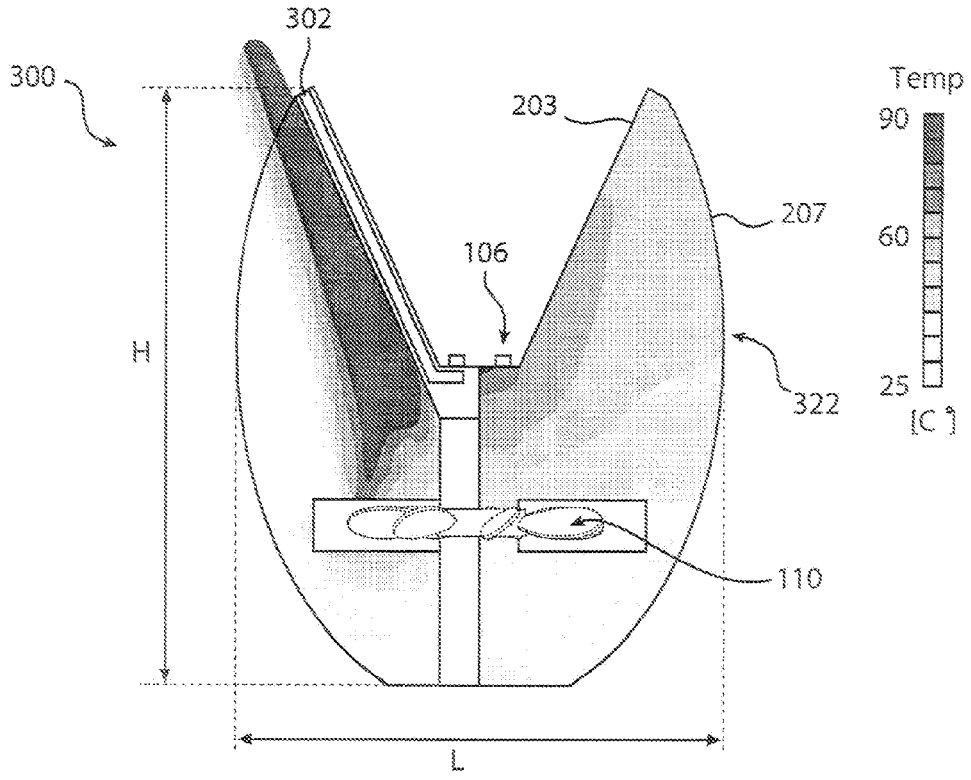
FIG. 3 illustrates the heat distribution in a cross-section of an embodiment of a heat managing device according to the present inventive concept, as a result of a heat simulation performed in ANSYS CFX v11.0.
Figure 4A:
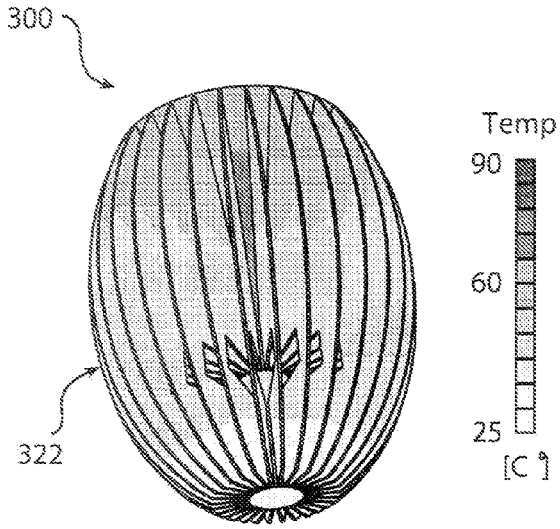
FIGS. 4*a* and 4*b* illustrate the heat distribution of an embodiment of a heat managing device according to the present inventive concept, as a result of a heat simulation performed in ANSYS CFX v11.0.
Figure 4B:
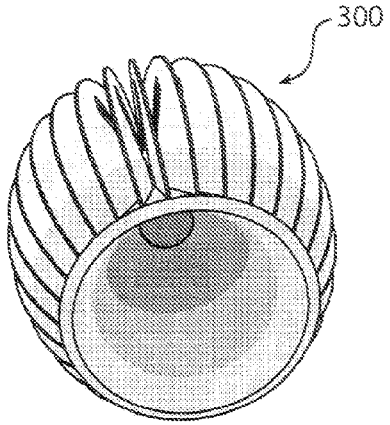

To demonstrate the inventive concept, thermal simulations of an exemplifying embodiment is illustrated in FIGS. 3 and 4. The lighting device 300 has basically the same structure as the embodiment of the heat managing device 200 for light sources 106 described with reference to FIG. 2. The heat pipes 302 are positioned in such a way to minimize the effect of gravity. One way of minimizing the effect of gravity may be to when a plurality of heat pipes are used, the heat pipes are arranged in different directions such that at least a few of them are always pointing in an upward direction (independent of the direction of the light source, as the direction of the light source may be altered in the application).

In an alternative embodiment (not shown), long heat pipes are arranged such that the middle of the heat pipes are embedded in the heat spreader such that the opposite ends of the long heat pipes form two cold parts towards which the vapor from the hot part (the middle of the long pipes) can escape.

The lighting device 300 is arranged with a light source comprising a LED array with 100 LEDs 106. (It should be noted that a device with more than 100 LEDs is applicable.) With the high number of LEDs, a lighting device emitting more than 500 lumen is achievable. This in turn will cause a considerable heat load of the order of 400 W (and possible more depending on the LEDs) which heat is originated in small areas in the order of 10 $cm^2$ or possibly less. The LEDs are arranged having 3 different colors, e.g. Red, Green and Blue, which allows a very good color mixing.

The light emitted by the LEDs 106 is collimated with a trumpet shaped reflector 203 as has been described in U.S. Pat. No. 6,200,002 B1, which also is an efficient color mixer. The reflector segments are flat in one direction and curved in another. The reflector surface 203 is a highly reflective thin film of Miro Silver by Alanod.

The lighting device 300 further comprises power supply and a color control unit which is not explicitly shown here. The lighting device 300 is arranged such that the LED array 106 is mounted on the heat spreader 104 of a heat managing device 200. Thereby a lighting device 300 with a high brightness color tunable spot may be achieved, which is capable of managing heat generated in the high power application.

The diameter L of the heat sink 322 is here 20 cm, and the length H of the heat sink 322 is here 30 cm. A commercially available fan 110, SUNON mec0251-v3) is utilized in the simulations, together with its own working curve. This is a 120×120×25 fan which is selected due to its low noise emission. The geometry of the heat sink 322 is here selected such that it is obtainable by die-cast aluminium. The number of thick tapered fins is selected between 27 and 36, having an average thickness around 2.5 mm. Optionally, a higher number of thin (0.2 mm) fins, obtained by extrusion can be used. A ratio between the number of heat pipes and fins is here set to 2/1 (one heat pipe every two fins), which guarantees a uniform heat spreading. However, a 3/1 ratio is a good candidate, should the need arise for compromise between heat spreading and complexity of the design.

FIG. 3 illustrates a cross-sectional view of the lighting device 300, showing thermal simulations using ANSYS CFX v11.0. The temperature pattern on the heat sink is shown in the left half of the embodiment in FIG. 3, where it can be seen that an even temperature distribution along the side of the heat pipes 302 is achieved. The temperature pattern on the left half of the embodiment in FIG. 3 is taken on a section plane. It shows the enhanced heat transfer ensured by the heat pipes: the temperature gradient is less steep along the heat pipes pattern. FIG. 4 illustrates thermal simulations of the whole embodiment: the temperature pattern on the outer skin of the heat sink matches the section in FIG. 3.

The size of the heat sink 102, 322 should be as large as possible. Limiting factors are the clearance of the whole heat managing device or lighting device 100, 200, 300, and the effectiveness of the heat pipes at keeping it at a uniform (and possibly high) temperature. Simulations show that the present inventive concept makes it possible to remove heat up to 500 W, while keeping the max temperature in the heat spreader below 90° C. (ambient air temperature 25° C.). The corresponding junction temperature of the LEDs is then in the range between 120° C. and 135° C., which is feasible with current LED technology. The heat managing device according to the present invention allows for keeping the junction temperature of the LEDs in the LED array at operating conditions (ambient air temperature 25° C.) substantially below 150° C., preferably below 135° C., and more preferably below 120° C., and most preferably below 90° C.

Figure 5A:
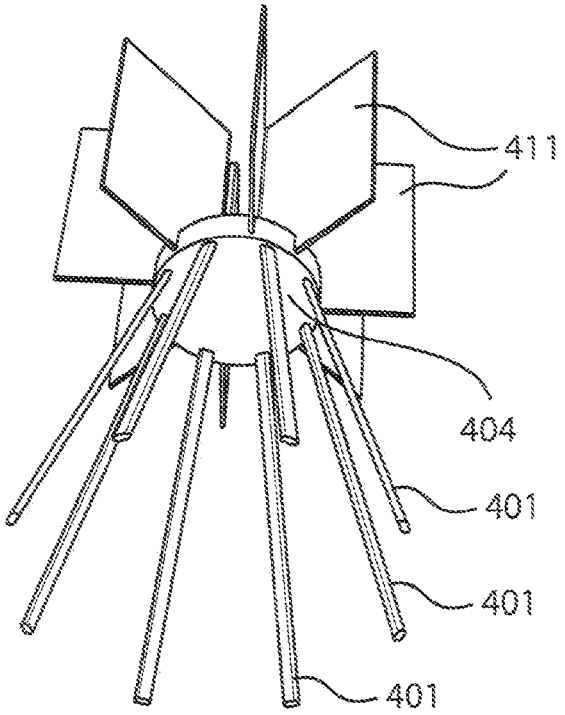
FIGS. 5*a* and 5*b* illustrate an upper and a lower perspective view, respectively, of a heat spreader provided with a first and a second set of heat pipes in accordance with an embodiment of a heat managing device according to the present inventive concept.
Figure 5B:
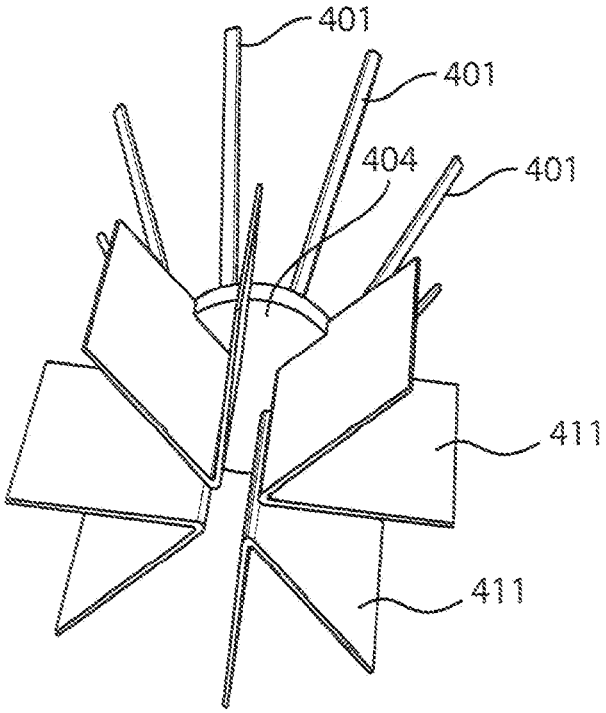

FIGS. 5*a* and 5*b* illustrates part of an embodiment, wherein the first set of heat pipes 401 and second set of heat pipes 411 are arranged as flat heat pipes, which are partly embedded in the heat spreader 404. The main feature of the embodiment is the use of the planar heat pipes 411 very close to the fan (not shown in FIG. 5). The heat pipes 411 then serve both as heat spreading and as wet surfaces, e.g. in contact with the air flow generated by the fan (110 in previous FIGS. 1-4). The implementation is beneficial for designs which are in need of decreased sensitivity to orientation (i.e. gravity) and which provide improved heat spreading. In fact planar heat pipes 411 may optionally extend to an area where the temperature of both the heat sink 322 and the air is comparatively low. The flat heat pips are particularly effective in the case where the optics is pointed downwards, as in applications like theatre spots due to the maximum effectiveness for the heat pipes.

Preferably a heat pipe is oriented such that the hot part of the heat pipe is placed at a lower position then the cold part, which allows the vapor to move easily towards the cold part. If the hot part generating the vapor would be in a higher position that the cold part, less efficient heating is achieved, as a continuous heat flow is more difficult to realize. In the case of planar heat pipes, the vapor has substantially two directions to escape from the hot part. It is more likely that one of these two directions is upwards and towards the cold part of the heat pipe.

The present inventive concept is applicable in e.g. automotive front lighting, spot lights or other general lighting units, theatre spots, and high power lighting.

The person skilled in the art realizes that the present invention by no means is limited to the preferred embodiments described above. On the contrary, many modifications and variations are possible within the scope of the appended claims.

The invention claimed is:

1. A heat managing device for a light source, said device comprising:

a heat spreading element having an upper side arranged for thermally connecting to at least one light source;

secondary optics for controlling light emitted from said light source;

a heat sink being thermally connected to said heat spreading element, said heat sink including a plurality of fins;

a first set of heat pipes being thermally connected to said heat spreading element; and a fan for providing forced air convection at said heat sink;

wherein at least a portion of said heat sink is arranged to encompass said secondary optics, wherein said heat pipes are embedded in said heat sink, and wherein at least one of said heat pipes is embedded in said heat sink at a base of one particular fin of said plurality of fins and is nearer to said particular fin than to any other fin of the heat sink.

2. A heat managing device according to claim 1, wherein said secondary optics is arranged at said heat spreading element to encompass said light source.

3. A heat managing device according to claim 1, wherein said heat sink further comprises a cavity in flow communication with space via at least one aperture, within which cavity said fan is arranged.

4. A heat managing device according to claim 1, wherein said first set of heat pipes is arranged to extend along said secondary optics.

5. A heat managing device according to claim 1, wherein said first set of heat pipes is arranged at a bottom side of said heat spreading element.

6. A heat managing device according to claim 1, further comprising a second set of heat pipes being thermally connected to said heat spreading element and arranged on an opposite side of the heat spreading element with respect to said first set of heat pipes.

7. A heat managing device according to claim 1, wherein said heat pipes are at least partly embedded in said heat spreading element.

8. A heat managing device according to claim 1, wherein said secondary optics is parabolic, elliptic or cone or trumpet shaped.

9. A heat managing device according to claim 1, wherein said heat sink comprises a parabolic or conical cavity in which said second optics is arranged.

10. A heat managing device according to claim 1, wherein said fins are configured such that the outer shape of the heat sink forms one of a truncated spheroid, a cylinder, or a truncated cone.

11. A heat managing device according to claim 1, wherein said at least one light source is a light emitting diode or a laser.

12. A heat managing device according to claim 1, wherein at least one of said heat pipes is a planar heat pipe.

13. A lighting device comprising at least one light source mounted in a heat managing device according to claim 1.

14. A lighting device according to claim 13, configured to retrofit into a luminaire employing an incandescent light source.

15. A lighting device according to claim 1, wherein said base extends along said secondary optics.

16. A lighting device according to claim 15, wherein the at least one of said heat pipes extends along the base.

17. A lighting device according to claim 16, wherein embedding of the at least one heat pipe at the base of the particular fin distributes heat throughout at least a portion of the particular fin such that the embedding enhances transfer of heat through material composing the particular fin when said light source is in operation.

18. A lighting device according to claim 1, wherein embedding of the at least one heat pipe at the base of the particular fin distributes heat throughout at least a portion of the particular fin such that the embedding enhances transfer of heat through material composing the particular fin when said light source is in operation.

* * * * *